US008453477B2

(12) United States Patent
Crespo et al.

(10) Patent No.: US 8,453,477 B2
(45) Date of Patent: Jun. 4, 2013

(54) PACKAGING SYSTEMS AND METHODS FOR COLD CHAIN SHIPMENTS

(75) Inventors: Joselito T. Crespo, Burlingame, CA (US); Paul G. Russell, Campbell, CA (US)

(73) Assignee: Life Technologies Corporation, Carlsbad, CA (US)

( * ) Notice: Subject to any disclaimer, the term of this patent is extended or adjusted under 35 U.S.C. 154(b) by 881 days.

(21) Appl. No.: 12/568,636

(22) Filed: Sep. 28, 2009

(65) Prior Publication Data

US 2011/0072847 A1 Mar. 31, 2011

(51) Int. Cl.
*F25D 3/08* (2006.01)

(52) U.S. Cl.
USPC ..... 62/457.2

(58) Field of Classification Search
USPC ..... 62/371, 457.2, 530
See application file for complete search history.

(56) References Cited

U.S. PATENT DOCUMENTS

| | | | |
|---|---|---|---|
| 5,105,970 | A | 4/1992 | Malone et al. |
| 5,143,245 | A | 9/1992 | Malone |
| 5,419,152 | A | 5/1995 | Silber |
| 6,119,567 | A | 9/2000 | Schindler et al. |
| 6,755,568 | B2 | 6/2004 | Malone et al. |
| 2003/0087051 | A1 | 5/2003 | Murray |
| 2007/0000983 | A1 | 1/2007 | Spurrel et al. |
| 2008/0276643 | A1 | 11/2008 | Heroux et al. |
| 2009/0078699 | A1 | 3/2009 | Mustafa et al. |

OTHER PUBLICATIONS

"Jiffy® Paper Packaging Products," [website page online]. [retrieved on Sep. 22, 2009], © 1997-2009. Retrieved from the Internet: <URL: http://www.sealedair.com/products/protective/paper/paper.html>.

"Custom Wrap™ and Kushion Kraft®," Sealed Air Product Brochure, [retrieved on Sep. 22, 2009], Oct. 2004. Retrieved from the Internet: <URL: http://www.sealedair.com/products/protective/paper/paper.html>.

"Versa-Pak™," NPS Product Brochure, [retrieved on Sep. 22, 2009], © 2002. Retrieved from the Internet: <URL: http://www.npscorp.com/versa-pak >.

International Search Report for Application No. PCT/US2010/050599 along with the Written Opinion of the International Searching Authority dated Jun. 27, 2011.

*Primary Examiner* — Melvin Jones

(57) ABSTRACT

A packaging system for cold chain shipment may include a container having interior surface portions, a plurality of cellulose sheets disposed along the interior surface portions and defining a space configured to receive an item for cold chain shipment, and a cold source disposed within the space and configured to cool the container for cold chain shipment. The packaging system may further include a plurality of cellulose sheets, wherein adjacent sheets of the plurality of cellulose sheets define a plurality of pockets configured to trap air, and wherein the plurality of cellulose sheets are configured to insulate the space.

31 Claims, 5 Drawing Sheets

PACKAGING SYSTEMS AND METHODS FOR COLD CHAIN SHIPMENTS

TECHNICAL FIELD

The present teachings relate to packaging systems and methods for cold chain shipments. More particularly, the present teachings relate to packaging systems and methods for cold chain shipments that use cellulose-based insulating materials.

INTRODUCTION

The section headings used herein are for organizational purposes only and are not to be construed as limiting the subject matter described in any way.

To facilitate and extend the shelf life of products, such as, for example, bio-agents (including, for example, perishable reagents, cell cultures, and the like), chemicals, foods and pharmaceutical drugs, from manufacture through distribution, a temperature-controlled supply chain (sometimes referred to as a cold chain) is generally required. An unbroken cold chain, for example, generally includes an uninterrupted series of storage and distribution activities, which consistently maintain a product's environment within a desired, relatively low, temperature range. Consequently, packaging used in cold chain shipments must often maintain a product's environment within the desired, relatively low temperature range for an extended period of time, thereby ensuring that the product's temperature stays within the proper temperature range for the entire duration of the cold chain, from manufacture to end use.

Products requiring cold chain shipment are typically cooled prior to shipment, then placed within a thermal insulating material, and shipped with only a modicum of ice or refrigerant to absorb the heat that flows from the environment external to the packaging through the insulation. For many years, molded expanded polystyrene ("EPS") containers have been used as a thermal insulating material for cold chain shipments. Perishable goods, for example, are generally placed within EPS containers (i.e., coolers), which are then in turn placed within cardboard or corrugated shipping boxes.

While providing satisfactory insulating qualities, as well as being generally light weight, EPS containers also pose issues. EPS, for example, is an "expanded," non-compressible material that consists of numerous small air bubbles formed in a polystyrene matrix. Accordingly, EPS's poor volume efficiency may increase shipment costs when transporting empty containers to a location for use, cause increased warehousing costs when storing containers prior to use, as well as increase product shipment costs by providing a container that is often larger than may be needed to contain the product, thereby, costing more to ship and necessitating more coolant.

Growing concerns for the environment, including for example concerns about global warming and excessive packaging waste, have also driven various environmental concerns regarding EPS containers. EPS's poor volume efficiency, for example, results in a greater amount of container waste material that needs to be recycled and/or disposed of. Furthermore, EPS is not currently widely recyclable at all recycling facilities.

Consequently, various "green," or environmentally friendly, packaging insulators, which use inflated air, foamed corn starch, or recycled EPS foam, have been developed for cold chain shipment applications. Such "green" options, however, still generally lack satisfactory volume efficiency (i.e., size of product to size of packaging) and viable (i.e., simple) recycling options. To replace conventional EPS and other insulating packaging materials, it may therefore be desirable to provide insulating packaging material that is not only made of a renewable resource, but also provides satisfactory insulating qualities and volume efficiency. It also may be desirable to provide insulating packaging material that offers a relatively simple recycling option using existing recycling infrastructure.

SUMMARY

The present teachings may solve one or more of the above-mentioned problems and/or may demonstrate one or more of the above-mentioned desirable features. Other features and/or advantages may become apparent from the description that follows.

In accordance with various exemplary embodiments of the present teachings, a packaging system for cold chain shipment may include a container having interior surface portions, a plurality of cellulose sheets disposed along the interior surface portions and defining a space configured to receive an item for cold chain shipment, and a cold source disposed within the space and configured to cool the container for cold chain shipment. The packaging system may further include a plurality of cellulose sheets, wherein adjacent sheets of the plurality of cellulose sheets define a plurality of pockets configured to trap air, and wherein the plurality of cellulose sheets are configured to insulate the space.

In accordance with various additional exemplary embodiments, a method for packaging an item for cold chain shipment may include disposing a plurality of cellulose sheets along interior surface portions of a container, disposing a cold source within the container, and disposing an item for cold chain shipment within the container. The method for packaging an item for cold chain shipment may further include substantially surrounding the item with a substantially uniform thickness of the plurality of cellulose sheets wherein adjacent sheets of the plurality of cellulose sheets define small pockets configured to trap air, and wherein the plurality of cellulose sheets insulate the item during cold chain shipment.

In accordance with various further exemplary embodiments, a method for preparing packaging for shipment of an item may include draping a plurality of cellulose sheets over a mandrel and inserting the mandrel and the plurality of cellulose sheets into a space defined by interior surface portions of a container. The method for preparing packaging for shipment may further include removing the mandrel from the space without removing the plurality of cellulose sheets, wherein the plurality of cellulose sheets define a substantially uniformly thick liner around interior surface portions of the container.

Additional objects and advantages will be set forth in part in the description which follows, and in part will be obvious from the description, or may be learned by practice of the present teachings. The objects and advantages may be realized and attained by means of the elements and combinations particularly pointed out in the appended claims and their equivalents.

It is to be understood that both the foregoing general description and the following detailed description are exemplary and explanatory only and are not restrictive of the claims.

BRIEF DESCRIPTION OF THE DRAWINGS

The present teachings can be understood from the following detailed description either alone or together with the accompanying drawings. The drawings are included to provide a further understanding, and are incorporated in and constitute a part of this specification. The drawings illustrate one or more exemplary embodiments of the present teachings and together with the description serve to explain various principles and operation.

DESCRIPTION OF VARIOUS EXEMPLARY EMBODIMENTS

Conventional cold chain shipping materials are often bulky and difficult to recycle. Such materials, for example, may cost more to ship and require the use of relatively large amounts of coolant, while also generating excessive amounts of often unrecyclable packaging waste. To increase shipping efficiency and the recyclability of packaging waste, various exemplary embodiments of the present teachings provide packaging systems and methods for cold chain shipment that use cellulose-based insulating materials that are conformable to a product's size so as to reduce the overall amount and size of the packaging. Such cellulose-based insulating materials are a renewable resource, generally originating from managed forests versus mined natural resources such as petroleum. Furthermore, such cellulose-based insulating materials can also be recycled with other paper products utilizing conventional paper recycling infrastructure, thereby facilitating the end receiver's (e.g., customer's) collection (e.g., large volumes of paper can be compacted in standard compactors) and recycling of the packaging (e.g., paper can be recycled at almost all recycling facilities). In various exemplary embodiments, packaging systems and methods for cold chain shipment use a plurality of cellulose sheets disposed along interior surface portions of a container, such as a cardboard box, wherein the plurality of cellulose sheets are configured to insulate an item for cold chain shipment.

Figure 1:
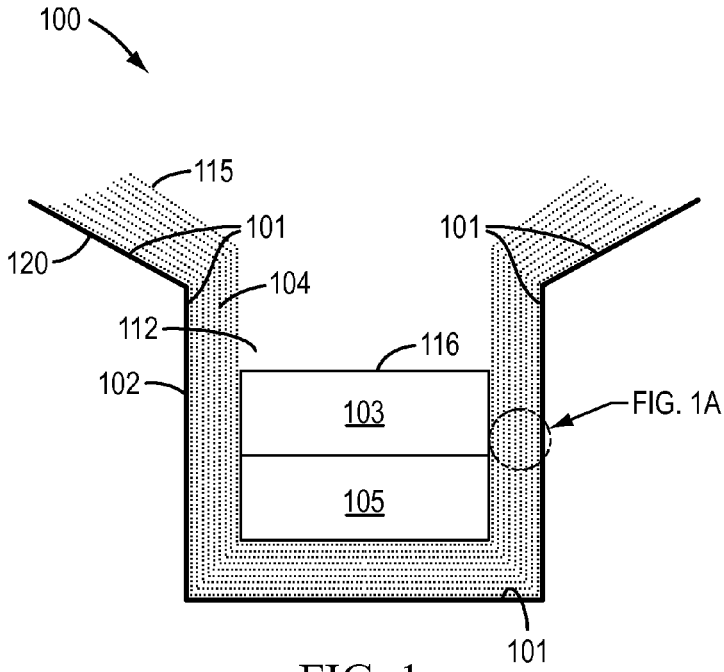
FIG. 1 illustrates an exemplary embodiment of a packaging system for cold chain shipment in accordance with the present teachings.

FIG. 1 illustrates an exemplary packaging system for cold chain shipment in accordance with exemplary embodiments of the present teachings. As shown in FIG. 1, a cold chain packaging system 100 may include a container 102 having interior surface portions 101 and a plurality of cellulose sheets labeled collectively as 104 disposed along the interior surface portions 101. The packaging system 100 may further include a cold source 103 configured to cool the container 102 for cold chain shipment.

The container 102 may comprise any carton, box and/or other structure suitable for containing an item and insulating material (i.e., the plurality of cellulose sheets) for cold chain shipment. For environmental purposes (e.g., including ease of recycling), for example, in various exemplary embodiments, the container 102 may be a standard cardboard box, for example, made from recycled materials. Those ordinarily skilled in the art will understand, however, that container 102 may be formed from various materials, including, for example, recycled paper, plastic and/or a wood material. Those ordinarily skilled in the art would further understand that the size of container 102 can be chosen based on the item being shipped, cost to make and/or ship, efficiency, and other such factors.

Figure 1A:
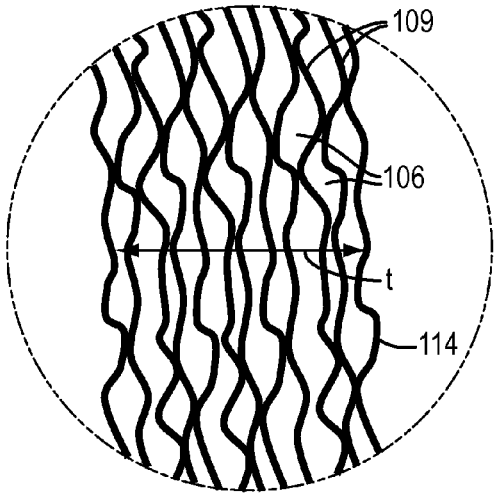
FIG. 1A is an exploded view of section A in FIG. 1.

The plurality of cellulose sheets 104 may line the interior surface portions 101 and define a space 112 within the container 102 configured to receive an item 105 for cold chain shipment. With reference to FIG. 1A, adjacent sheets 109 of the plurality of cellulose sheets 104 may contact one another at various locations along each sheet 109 to define a plurality of pockets 106 configured to trap air. The pockets 106 are relatively small pockets that substantially prevent air current movement, thereby substantially trapping air within each pocket 106. Although air tends to become trapped in the formed pockets 106, in various exemplary embodiments, the contact that occurs between adjacent sheets 109 at various locations along the sheets 109 is not a sealed contact. Thus, if sufficient pressure were exerted on a pocket, air may be capable of escaping from a pocket 109. In various alternative embodiments, the locations of contact may be sealed, however.

The number and configuration of the pockets 106 and the consequent trapping of air provide a thermal insulating barrier suitable for cold chain shipment. In various exemplary embodiments, adjacent cellulose sheets 109 may define, for example, from about 10 to about 50 pockets per square inch, for example, about 30 pockets per square inch. By way of further example, one layer of the plurality of cellulose sheets 108 (see FIG. 2B) may define from about 180 to about 900 pockets per square inch through a thickness of the layer 108, for example, about 540 pockets per square inch through the thickness.

The plurality of cellulose sheets 104 are configured to insulate the space 112, ensuring that the temperature of an item 105, such as, for example, a bio-agent, stays, within a desired temperature range for the entire duration of the cold chain shipment. In various exemplary embodiments, for example, the plurality of cellulose sheets 104 are configured to maintain the space 112 at a temperature sufficient for cold chain shipment for a time period of at least about 25 hours, or for example, at least about 30 hours. In various additional exemplary embodiments, the plurality of cellulose sheets 104 are configured to maintain the space 112 at a temperature of less than or equal to about 8° C., less than or equal to about 2° C., or less than or equal to about −10° C., for a period of time sufficient for cold chain shipment.

Those ordinarily skilled in the art will understand that the plurality of cellulose sheets 104 may have any number of configurations suitable for insulating space 112 without departing from the scope of the present teachings. In various exemplary embodiments of the present teachings, the plurality of cellulose sheets 104 may comprise at least one layer of cellulose wadding 108 (as shown schematically, for example, in FIG. 2B). And in various additional exemplary embodiments, the at least one layer of cellulose wadding 108 may further comprise a plurality of embossed tissue paper sheets. In still further exemplary embodiments, the plurality of cellulose sheets 104 may comprise plural layers of cellulose wadding 108, such as, for example, three layers of cellulose wadding as shown in the exemplary embodiment of FIG. 2B. Those having ordinary skill in the art would understand however that any number of layers of cellulose wadding may be used depending on the desired insulation, the item being shipped, and other factors.

In various additional exemplary embodiments, the plurality of cellulose sheets 104 may define a substantially uniformly thick lining 114 along the interior surface portions 101 of the container 102, wherein a thickness t of the lining 114 is, for example, greater than or equal to about 1.5 inches. Those ordinarily skilled in the art will also understand, however, that the plurality of cellulose sheets 104 may have any number of configurations based upon the specific factors of a shipping application, including, for example, the payload size (i.e., the size of the item 105 being shipped), the type of cold source 103, the average ambient temperature, and the shipment time. Various exemplary embodiments of the present teachings consider, for example, a substantially linear relationship between the thickness t of the lining 114 and the lining's insulating properties (e.g., doubling the thickness t doubles the insulating effects). Accordingly, various embodiments of the present teachings contemplate adjusting the thickness t of the lining 114 based upon shipment application.

Those ordinarily skilled in the art will further understand that the plurality of cellulose sheets 104 may comprise any type of cellulose wadding, dunnage, stuffing, padding and/or packing material configured and arranged so as to form a plurality of air pockets, as described with reference to FIG. 1A. By way of non-limiting example, the plurality of cellulose sheets 104 may include cellulose wadding, such as, for example, Custom Wrap™ wadding commercially available from Sealed Air Corp. or Versa-Pak™ cushioning products commercially distributed by NPS Corp. of Greenbay, Wis. Those ordinarily skilled in the art will understand, however, that the plurality of cellulose sheets 104 may be formed from various materials, including, for example, recycled paper, cotton and/or a wood material, and that the type of material may be chosen based on application, cost, thermal performance, and other such factors.

In various embodiments of the present teachings, the plurality of cellulose sheets 104 may have an R-Value (i.e., thermal performance rating) of greater than or equal to about 2. In various additional embodiments, the plurality of cellulose sheets 104 may comprise a hydroscopic cellulose material that wicks moisture produced by the cold source 103 away from the space 112. Although not wishing to be bound by any particular theory, it is believed that providing such a wicking effect may subject the plurality of cellulose sheets 104 to a freeze/thaw cycle that may for an initial time period, or for approximately half the duration of shipment, decrease the temperature of space 112 to lower than the cold source temperature (i.e., causing evaporative cooling).

In various additional exemplary embodiments, the plurality of cellulose sheets 104 may substantially conform to the item 105 for cold chain shipment, thereby also providing exceptional volume efficiency (i.e., size of the item 105 to size of the container 102). Consequently, when appropriate, smaller containers may be utilized to reduce the amount of required coolant and reduce shipping costs. Those of ordinary skill in the art would further understand that the plurality of cellulose sheets 104 may be generally substantially compressible/packable, which may also reduce shipment costs when transporting packaging to a location for use and reduce warehousing costs when storing packaging prior to use.

As shown in FIG. 1, the cold source 103 may also be disposed within the space 112 to cool the container 102 for cold chain shipment. The cold source 103 may comprise any type of coolant, refrigerant and/or combination thereof suitable for a cold chain shipping application in accordance with the present teachings. The cold source 103 may be configured, for example, to cool at least a portion of the space 112 to a temperature less than or equal to about 8° C. prior to shipment.

In various exemplary embodiments of the present teachings, the cold source 103 may comprise dry ice, whereas in various additional exemplary embodiments, the cold source 103 may comprise at least one frozen gel pack. In various further exemplary embodiments, the cold source 103 may also comprise the item 105 itself if the item 105 is cooled to a temperature suitable for cold chain shipment prior to being packaged in the system 100. The type and/or amount of cold source 103 can therefore be chosen based on application, cost, temperature, efficiency, and other such factors. In various exemplary embodiments, for example, the cold source 103 may comprise from about 1.5 to about 5 lbs of dry ice, for example, about 3.5 lbs of dry ice loaded on top of item 105.

In accordance with various exemplary embodiments of the present teachings, an exemplary method for packaging an item 105 in a container 102 for cold chain shipping, as illustrated in FIG. 1, will now be described. To package an item 105 for cold chain shipping, for example, a plurality of cellulose sheets 104 may be disposed along interior surface portions 101 of a container 102. Various exemplary embodiments of the present teachings contemplate, for example, disposing at least one layer of cellulose wadding 108 (see FIG. 2B) along interior surface portions 101 of the container 102. Various additional embodiments contemplate disposing the plurality of cellulose sheets 104 along interior surface portions 101 of a cardboard box.

The item 105 and a cold source 103 may then be placed within the space 112 defined by the plurality of cellulose sheets 104. Various exemplary embodiments contemplate, for example, placing the cold source 103, which may be, for example, dry ice or a frozen gel pack, on top of the item 105, as shown in FIG. 1. However, those ordinarily skilled in the art would realize that such positioning is exemplary only and that the cold source can be placed around one or more sides of the item 105.

To insulate the item 105 during cold chain shipment, the plurality of cellulose sheets 104 may be positioned and arranged to substantially surround the item 105 with a substantially uniform thickness t of the plurality of cellulose sheets 104. In various exemplary embodiments of the present teachings, to substantially surround the item 105, the size of the plurality of cellulose sheets 104 should be such that edge portions 115 extend beyond the item 105 and any cold source 103 to an extent sufficient to fold the edge portions 115 over the upper surface portion 116 defined by the structures placed in the space 112. For example, in the exemplary embodiment of FIG. 1B, the edge portions 115 can fold over the upper surface portion 116 of the cold source. As described above, in various exemplary embodiments, the plurality of cellulose sheets 104 may be disposed and arranged within the container 102 to substantially surround the item 105 with a substantially uniform thickness t greater than or equal to about 1.5 inches.

Figure 1B:
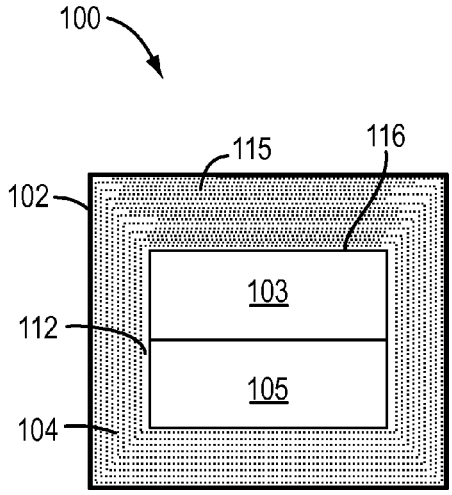
FIG. 1B shows the system of FIG. 1 in a closed position.

As shown in FIG. 1B, once the edge portions 115 have been folded down and along the upper surface portion 116, container 102 may be closed and secured for shipment, as those ordinarily skilled in the art are familiar.

In accordance with various exemplary embodiments of the present teachings, an exemplary method for preparing packaging for shipment of an item will now be described with reference to FIGS. 2A-2E.

Figure 2A:
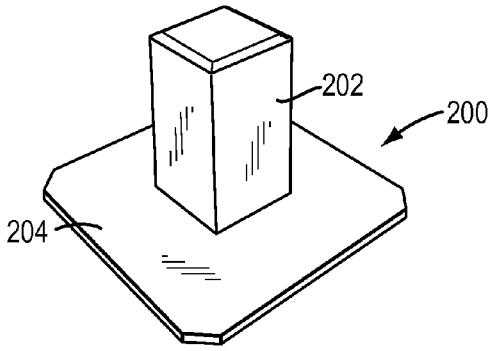
FIGS. 2A-2E show exemplary steps of a method for preparing packaging for cold chain shipment in accordance with the present teachings.

FIG. 2A illustrates an exemplary mandrel 200 in accordance with exemplary embodiments of the present teachings. The mandrel 200 includes a base 204 and a spindle 202. The mandrel 200 may be formed from various materials, including, for example, plastic, wood, metal and/or any combination thereof. Those ordinarily skilled in the art will understand that mandrel 200 is exemplary only and not intended to limit the present teachings or claims. The size, shape and/or configuration of mandrel 200 can be chosen based on the size of the item being shipped, the size of the shipment container, and other similar factors.

Figure 2B:
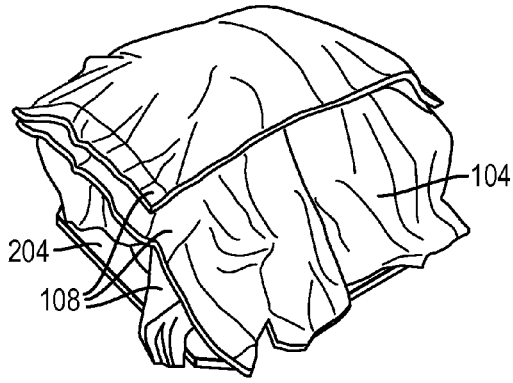

As illustrated in FIG. 2B, to prepare packaging for cold shipment of an item, a plurality of cellulose sheets 104 including adjacent sheets 109 forming a plurality of air pockets 106 (see FIG. 1A) may be draped over a spindle 202. Various exemplary embodiments of the present teachings contemplate, for example, draping at least one layer of cellulose wadding 108 over the spindle 202, whereas, as shown in FIG. 2B, various additional embodiments contemplate draping plural layers of cellulose wadding 108, for example, three layers as shown in FIG. 2B, over the spindle 202. To help ensure that a substantially uniformly thick lining of cellulose sheets 104 is disposed along the interior surfaces of the container and that the cellulose sheets 104 substantially evenly surround an item for cold chain shipment, plural layers of cellulose wadding 108 may be draped over the spindle 202 in an offset manner to ensure that substantially the entire surface area of the spindle 202 is covered with cellulose wadding, as shown in FIG. 2B. In various exemplary embodiments, the various layers 108 may have differing dimensions, also to help ensure a substantially uniformly thick lining is provided in the container.

Figure 2C:
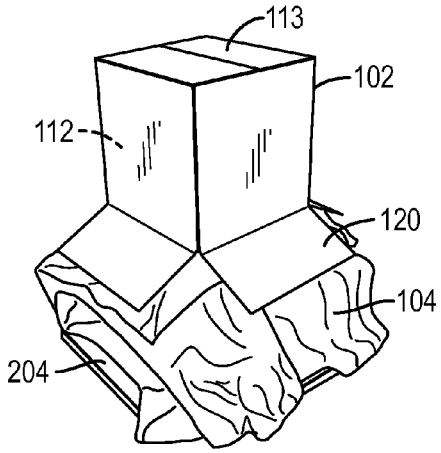
Figure 2E:
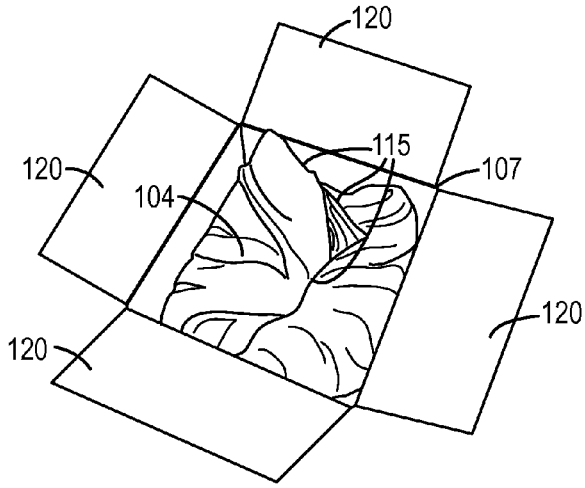
Figure 2D:
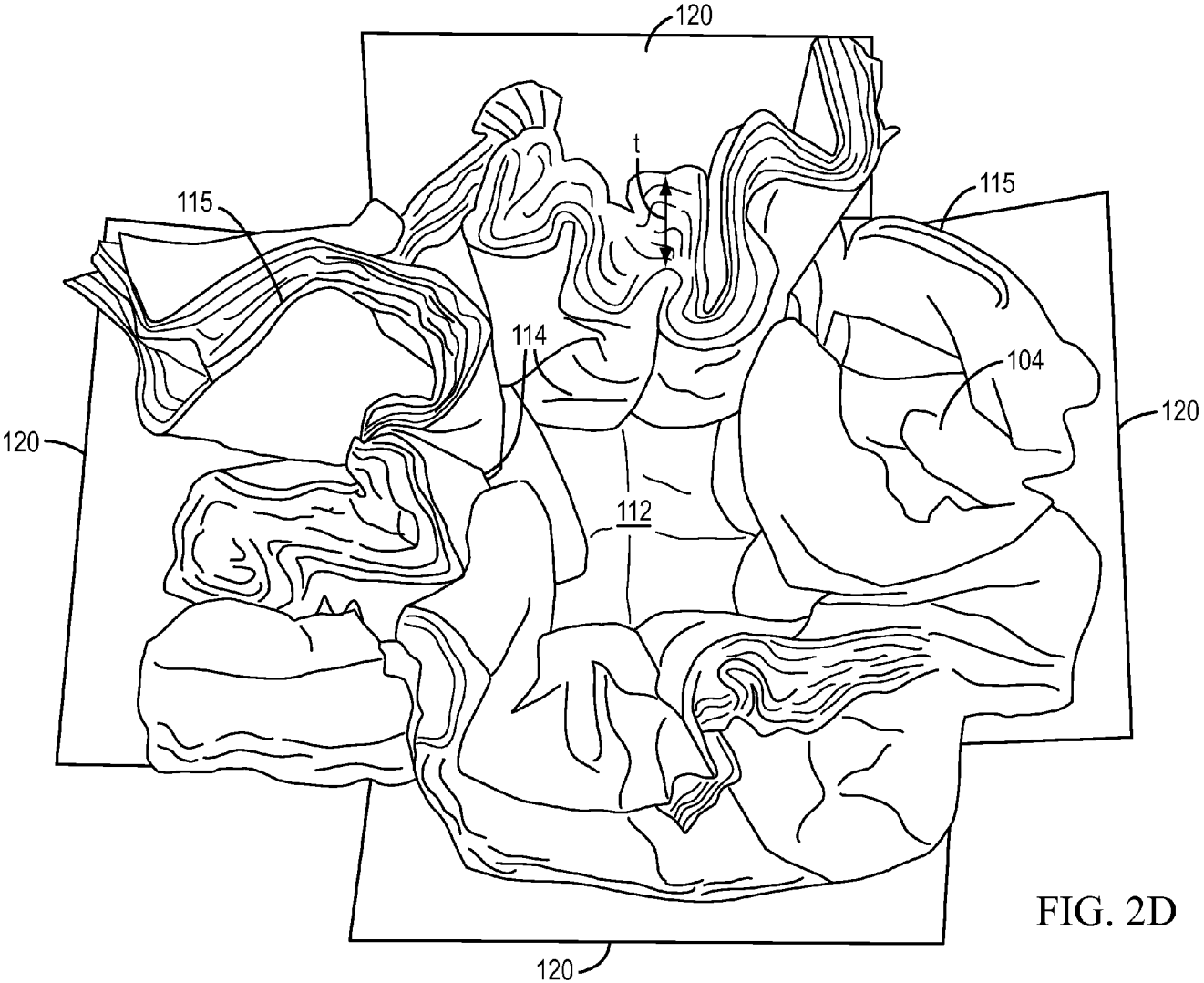

As illustrated in FIG. 2C, the spindle 202 and the plurality of cellulose sheets 104 may be inserted into a chamber of the container 102 defined by interior surface portions 101 (see FIG. 1). By way of example, the container 102 may be inverted from its position shown in FIG. 1 and advanced over the spindle 202 and the plurality of cellulose sheets 104. Once advanced so that the closed end 113 of the container 102 contacts or is in close proximity to the plurality of cellulose sheets 104, the container 102 may be removed from the mandrel 200 without removing the plurality of cellulose sheets 104. As shown in FIG. 2D, the plurality of cellulose sheets 104 remain in the chamber of the container 102 and define a substantially uniformly thick liner 114, for example, of greater than or equal to about 1.5 inches, around interior surface portions 101 (see FIG. 1) of the container 102.

Once the plurality of cellulose sheets 104 are placed in the container 102, as depicted in FIG. 2D, an item for cold chain shipment, such as, for example, item 105 shown in FIG. 1, may be placed into the space 112. Optionally, a cold source, such as, for example, cold source 103 illustrated in FIG. 1, also may be placed in the space 112. Referring to FIG. 2E, edge portions 115 of the plurality of cellulose sheets 104 located proximate an open end 107 of the container 102 may then be folded down over the item and, if desired, a cold source placed in the space 112. The open flaps 120 of the container 102 may then be closed and secured for shipment of the package.

Figure 3:
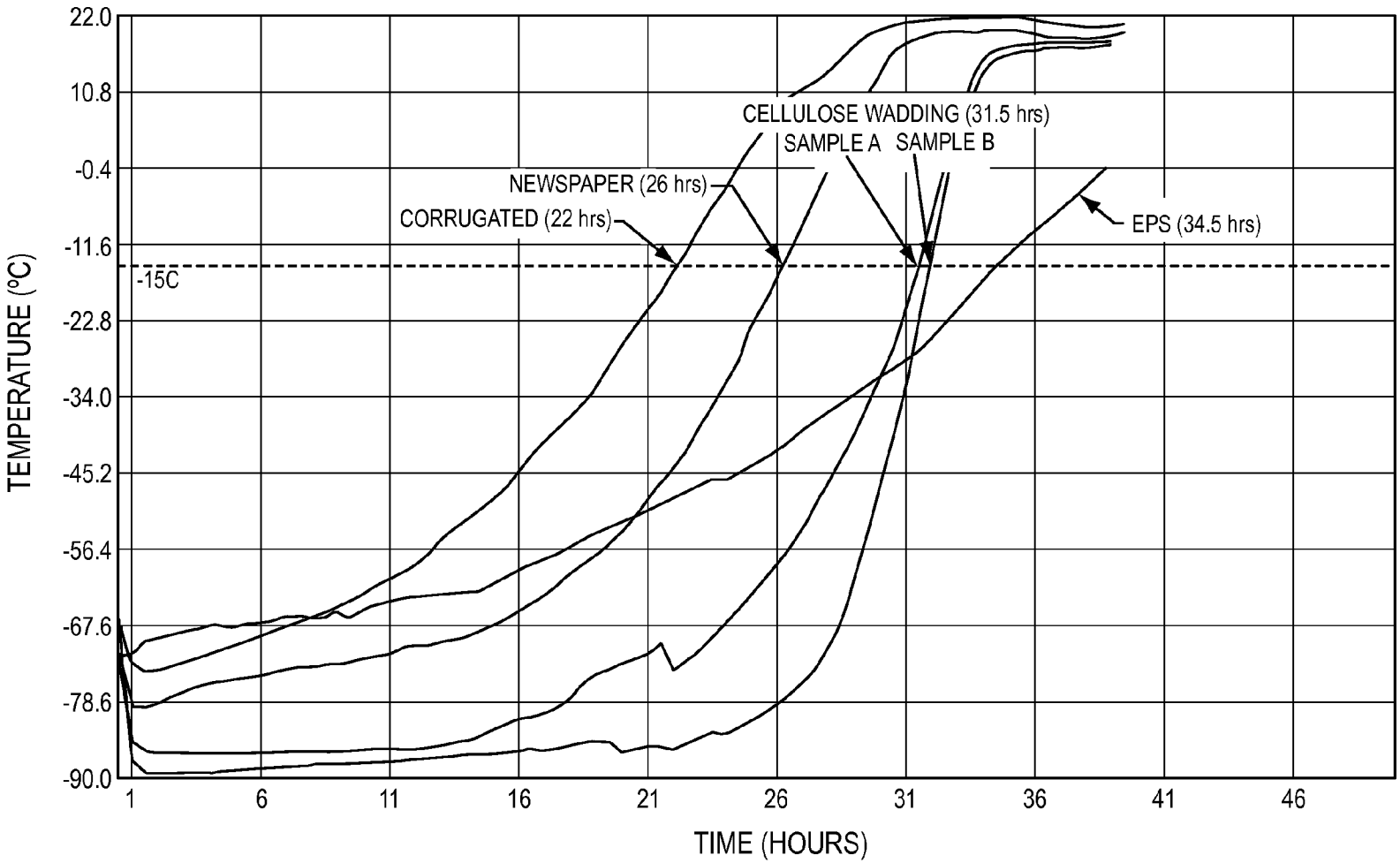
FIG. 3 is a graph comparing temperature changes over time experienced by items for cold chain shipment using various insulating packaging materials.
Figure 4:
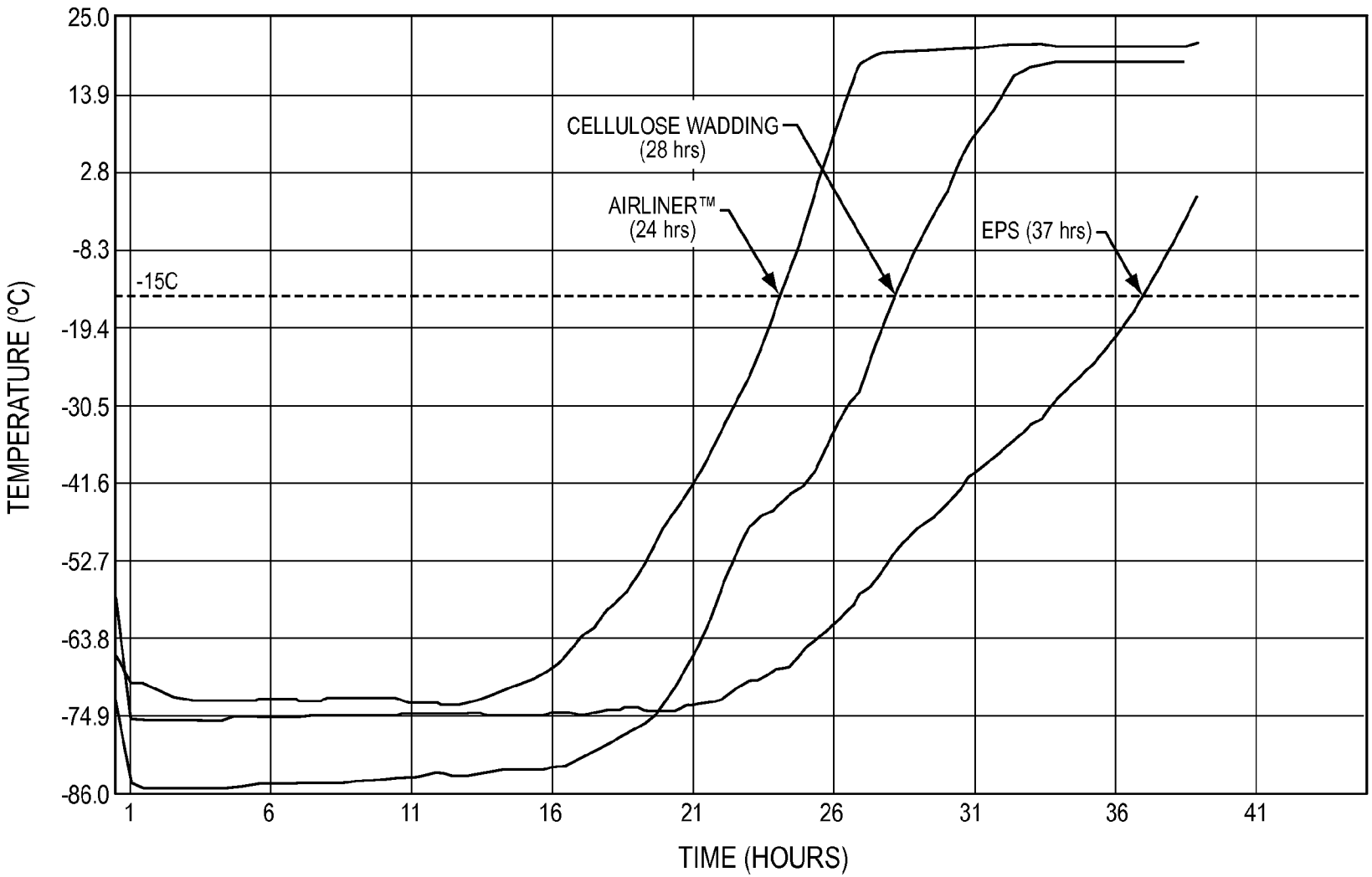
FIG. 4 is a graph comparing temperature changes over time experienced by items for cold chain shipment using a various insulating packaging materials.

To verify the thermal insulating efficiency of the systems and methods in accordance with exemplary embodiments of the present teachings, several experiments were conducted with the results being illustrated in FIGS. 3 and 4.

In FIG. 3, temperature changes over time were plotted for various experimental packaging systems. In the experiments, experimental packaging systems comprising a corrugated liner, a newspaper liner and cellulose wadding liners, lining 2.5"×2"×2.25" cardboard boxes, were loaded with 3.5 lbs of dry ice and compared with a conventional EPS system comprising a 6"×5.375"×4.5" EPS cooler, with an average wall thickness of 1.5 inches, placed within a 9"×9"×9" cardboard box and also loaded with 3.5 lbs of dry ice. A temperature probe was attached to a sample within the packaging system, which comprised between 2 to 4, 2 ml tubes of a pre-frozen liquid, to measure the air space around the sample. The packaging systems were kept in an ambient environment and the temperature was measured every 30 minutes. Temperature changes over time were plotted noting specifically the time at which each system's temperature crossed a −15° C. threshold (i.e., representing the acceptable upper limit for products packaged in dry ice).

Two separate samples of cellulose wadding (sample A and sample B) were tested. Sample A comprised three layers of standard Custom Wrap™ wadding (ULine® model number S610), each layer being 18 ply with a thickness of 0.5 inches, for a total thickness of 1.5 inches. Sample B comprised three layers of standard Versa-Pak™ wadding (ULine® model number S3577), each layer with a thickness of 0.5 inches, for a total thickness of 1.5 inches. As shown in FIG. 3, both samples of cellulose wadding demonstrated sufficient thermal insulating efficiency that was comparable to the conventional EPS system, by maintaining a temperature of less than or equal to about −15° C. for a period of time of about 31.5 hours. Based on the temperature profile shown in FIG. 3, and as explained above, although not wishing to be bound by theory, the cellulose wadding may create an evaporative cooling effect, leading to lower temperatures exhibited over an initial time period of about 10 to 15 hours for the cellulose wadding.

In FIG. 4, temperature changes over time were plotted for a packaging system in accordance with the present teachings versus several other cold chain packaging technologies. In the experiments, packaging systems comprising a cardboard box with an outer dimension of 9"×9"×9" were insulated with inflated air bladders (the AirLiner®), cellulose wadding, and a conventional 6"×5.375"×4.5" EPS cooler, and loaded with 3.5 lbs of dry ice. As before, a temperature probe was attached to a sample within the packaging system, which comprised between 2 to 4, 2 ml tubes of a pre-frozen liquid, to measure the air space around the sample. The packaging systems were kept in an ambient environment and sampled every 30 minutes. Temperature changes over time were plotted noting specifically the time at which each system's temperature crossed the −15° C. threshold (i.e., representing the acceptable upper limit for products packaged in dry ice).

The cellulose wadding system comprised three layers of standard Custom Wrap™ wadding (ULine® model number S610), 18 ply with a thickness of 0.5 inches, for a total thickness of 1.5 inches. As shown in FIG. 4, the cellulose wadding demonstrated sufficient thermal insulating efficiency, achieving greater thermal efficiency then the AirLiner®, and maintaining a temperature of less than or equal to about −15° C. for a period of time of about 28 hours. Based on the temperature profile shown in FIG. 4, and as explained above, although not wishing to be bound by theory, the cellulose wadding may create an evaporative cooling effect, leading to lower temperatures exhibited over an initial time period of about 10 to 15 hours for the cellulose wadding.

Accordingly, FIGS. 3 and 4 demonstrate that the packaging systems and methods in accordance with exemplary embodiments of the present teachings demonstrate sufficient thermal insulating efficiency for cold chain shipments.

For the purposes of this specification and appended claims, unless otherwise indicated, all numbers expressing quantities, percentages or proportions, and other numerical values used in the specification and claims, are to be understood as being modified in all instances by the term "about" if they are not already. Accordingly, unless indicated to the contrary, the numerical parameters set forth in the following specification and attached claims are approximations that may vary depending upon the desired properties sought to be obtained by the present teachings. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

It is noted that, as used in this specification and the appended claims, the singular forms "a," "an," and "the," and any singular use of any word, include plural referents unless expressly and unequivocally limited to one referent. As used herein, the term "include" and its grammatical variants are intended to be non-limiting, such that recitation of items in a list is not to the exclusion of other like items that can be substituted or added to the listed items.

It should be understood that while the present teachings have been described in detail with respect to various exemplary embodiments thereof, it should not be considered limited to such, as numerous modifications are possible without departing from the broad scope of the appended claims.

We claim:

1. A packaging system for cold chain shipment, the packaging system comprising:

a container having interior surface portions;

a plurality of cellulose sheets disposed along the interior surface portions and defining a space configured to receive an item for cold chain shipment, wherein the plurality of cellulose sheets substantially conforms to and contacts the item for cold chain shipment; and a cold source disposed within the space and configured to cool the container for cold chain shipment, wherein adjacent sheets of the plurality of cellulose sheets define a plurality of pockets configured to trap air, and wherein the plurality of cellulose sheets are configured to insulate the space.

2. The packaging system of claim 1, wherein the cold source comprises dry ice.

3. The packaging system of claim 1, wherein the cold source comprises at least one frozen gel pack.

4. The packaging system of claim 1, wherein the cold source comprises the item for cold chain shipment.

5. The packaging system of claim 1, wherein the cold source is configured to cool at least a portion of the space to a temperature less than or equal to about 8° C. prior to shipment.

6. The packaging system of claim 1, wherein the container is a cardboard box.

7. The packaging system of claim 1, wherein the plurality of cellulose sheets comprise at least one layer of cellulose wadding.

8. The packaging system of claim 7, wherein the at least one layer of cellulose wadding comprises a plurality of embossed tissue paper sheets.

9. The packaging system of claim 7, wherein the plurality of cellulose sheets comprise plural layers of cellulose wadding.

10. The packaging system of claim 1, wherein the plurality of cellulose sheets define a substantially uniformly thick lining along the interior surface portions of the container.

11. The packaging system of claim 10, wherein a thickness of the lining is greater than or equal to about 1.5 inches.

12. The packaging system of claim 1, wherein the plurality of cellulose sheets are configured to maintain the space at a temperature sufficient for cold chain shipment for a time period of at least about 25 to 30 hours.

13. The packaging system of claim 1, wherein the plurality of cellulose sheets are configured to maintain the space at a temperature of less than or equal to about 8° C. for a period of time sufficient for cold chain shipment.

14. The packaging system of claim 1, wherein the plurality of cellulose sheets are configured to maintain the space at a temperature of less than or equal to about 2° C. for a period of time sufficient for cold chain shipment.

15. The packaging system of claim 1, wherein the plurality of cellulose sheets are configured to maintain the space at a temperature of less than or equal to about −10° C. for a period of time sufficient for cold chain shipment.

16. A method for packaging an item for cold chain shipment, the method comprising:

disposing a plurality of cellulose sheets along interior surface portions of a container;

disposing a cold source within the container;

disposing an item for cold chain shipment within the container; and substantially conforming the plurality of cellulose sheets to contact the item with a substantially uniform thickness of the plurality of cellulose sheets wherein adjacent sheets of the plurality of cellulose sheets define pockets configured to trap air, and wherein the plurality of cellulose sheets insulate the item during cold chain shipment.

17. The method of claim 16, wherein substantially surrounding the item with the plurality of cellulose sheets comprises folding edge portions of the plurality of cellulose sheets over a portion of the item.

18. The method of claim 16, wherein substantially surrounding the item with a substantially uniform thickness of the plurality of cellulose sheets comprises surrounding the item with a substantially uniform thickness of greater than or equal to about 1.5 inches.

19. The method of claim 16, further comprising closing and securing the container for shipment.

20. The method of claim 16, wherein disposing the plurality of cellulose sheets comprises disposing the plurality of cellulose sheets along interior surface portions of a cardboard box.

21. The method of claim 16, wherein disposing the plurality of cellulose sheets comprises disposing at least one layer of cellulose wadding along interior surface portions of the container.

22. The method of claim 16, wherein disposing a cold source within the container comprises disposing dry ice within the container.

23. The method of claim 16, wherein disposing a cold source within the container comprises disposing at least one frozen gel pack within the container.

24. A method for preparing packaging for shipment of an item, the method comprising:

draping a plurality of cellulose sheets over a mandrel;

inserting the mandrel and the plurality of cellulose sheets into a space defined by interior surface portions of a container; and removing the mandrel from the space without removing the plurality of cellulose sheets, wherein the plurality of cellulose sheets define a substantially uniformly thick liner around interior surface portions of the container.

25. The method of claim 24, further comprising disposing a cold source and/or an item for cold chain shipment into the space of the container.

26. The method of claim 24, further comprising folding down edge portions of the plurality of cellulose sheets located proximate an open end of the container.

27. The method of claim 26, further comprising closing and securing the open end of the container for shipment.

28. The method of claim 24, wherein draping a plurality of cellulose sheets over the mandrel comprises draping at least one layer of cellulose wadding over the mandrel.

29. The method of claim 28, wherein draping a plurality of cellulose sheets over the mandrel comprises draping plural layers of cellulose wadding over the mandrel.

30. The method of claim 24, wherein draping the plurality of cellulose sheets over the mandrel comprises draping a plurality of cellulose sheets, wherein adjacent sheets of the plurality of cellulose sheets define a plurality of pockets configured to trap air.

31. The method of claim 24, wherein the plurality of cellulose sheets define a substantially uniformly thick liner having a thickness of greater than or equal to about 1.5 inches.

* * * * *